US011560825B2

(12) United States Patent
Diehl et al.

(10) Patent No.: US 11,560,825 B2
(45) Date of Patent: Jan. 24, 2023

(54) MUFFLER HEAT PROTECTION ASSEMBLY

(71) Applicant: Honda Motor Co., Ltd., Tokyo (JP)

(72) Inventors: Russell A. Diehl, Dublin, OH (US); Orlando Otero-Solivan, Guaynabo, PR (US); Junichi Nakano, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 448 days.

(21) Appl. No.: 16/656,272

(22) Filed: Oct. 17, 2019

(65) Prior Publication Data

US 2021/0115835 A1 Apr. 22, 2021

(51) Int. Cl.

| | |
|---|---|
| ***F01N 13/14*** | (2010.01) |
| ***F01N 11/00*** | (2006.01) |
| ***F01N 13/18*** | (2010.01) |
| ***F01N 1/02*** | (2006.01) |

(52) U.S. Cl.

CPC ..... *F01N 13/143* (2013.01); *F01N 1/02* (2013.01); *F01N 11/007* (2013.01); *F01N 13/1805* (2013.01); *F01N 13/1855* (2013.01)

(58) Field of Classification Search

CPC ..... F01N 2260/20; F01N 13/08; F01N 13/20
See application file for complete search history.

(56) References Cited

U.S. PATENT DOCUMENTS 2,363,236 A * 11/1944 Fluor ..... F01N 3/005 181/262
3,348,629 A * 10/1967 Cassel ..... F01N 13/082 181/232
3,602,334 A * 8/1971 Goodman ..... F01N 13/00 181/243
3,972,687 A 8/1976 Frietzsche
4,265,332 A * 5/1981 Presnall ..... F01N 13/082 181/211
RE31,104 E * 12/1982 Baldi ..... B01J 23/60 416/241 A
4,487,289 A * 12/1984 Kicinski ..... F01N 1/08 181/252
5,170,557 A 12/1992 Rigsby
5,832,723 A * 11/1998 Iwata ..... F01N 13/008 60/276

(Continued)

FOREIGN PATENT DOCUMENTS

CN 201650425 U 11/2010
DE 4039735 A1 6/1996

(Continued)

*Primary Examiner* — Anthony Ayala Delgado
(74) *Attorney, Agent, or Firm* — Plumsea Law Group, LLC

(57) ABSTRACT

A muffler heat protection system for a vehicle includes a muffler heat shield configured to extend circumferentially around a portion of a muffler, the muffler heat shield having a first end and a second end; a heat shield extension secured to the first end of the muffler heat shield; a double wall exhaust pipe including an inner exhaust pipe and an outer covering pipe disposed over the inner exhaust pipe, the outer covering pipe having a first end portion and a second end portion, and the inner exhaust pipe having a first end portion and a second end portion; wherein the second end portion of the outer covering pipe is welded to the muffler at a welded connection seam; and wherein the heat shield extension projects outward from the muffler heat shield over the welded connection seam.

20 Claims, 6 Drawing Sheets

(56) References Cited

U.S. PATENT DOCUMENTS 6,438,949 B1 * 8/2002 Nozaki ..... B60K 13/04 123/184.21
7,374,016 B2 * 5/2008 Yamaguchi ..... F01N 1/084 181/249
8,356,639 B2 1/2013 Merry
8,522,828 B2 9/2013 Merry
9,512,771 B2 * 12/2016 Mahira ..... F01N 3/2803
2002/0050419 A1 * 5/2002 Dooley ..... F01N 13/14 181/228
2006/0000668 A1 * 1/2006 Yamaguchi ..... F01N 13/14 181/249
2006/0042871 A1 * 3/2006 Yasuda ..... F01N 1/24 181/227
2006/0067860 A1 3/2006 Faircloth, Jr. et al.
2015/0014083 A1 * 1/2015 Yamada ..... B60K 13/04 180/309
2015/0060026 A1 * 3/2015 Kim ..... B32B 15/20 165/133
2016/0237876 A1 8/2016 Ichihashi et al.
2016/0319728 A1 * 11/2016 Jenison ..... F01N 13/002
2017/0002717 A1 1/2017 Dietz et al.
2017/0030263 A1 * 2/2017 Rowe ..... F01N 13/082
2017/0167333 A1 * 6/2017 Masui ..... F01N 3/2885
2017/0350301 A1 12/2017 Assenbaum et al.
2019/0101041 A1 4/2019 Willats et al.
2019/0276103 A1 * 9/2019 Ono ..... B62D 21/18
2021/0237799 A1 * 8/2021 Kim ..... B21D 53/88
2021/0341370 A1 * 11/2021 Luthe ..... G01N 15/0618

FOREIGN PATENT DOCUMENTS

DE 102012007581 A1 10/2012
JP 2001123829 A * 5/2001 ..... B60K 13/04

* cited by examiner

MUFFLER HEAT PROTECTION ASSEMBLY

BACKGROUND

1. Field of the Invention

The present disclosure relates to motor vehicles and, in particular, to a muffler heat protection assembly for motor vehicle exhaust systems.

2. Description of Related Art

Motor vehicles having internal combustion engines are often provided with an exhaust system to expel exhaust gases to the rear of the vehicle. The exhaust system typically includes one or more conduits for conveying exhaust gases from the internal combustion engine to one or more tail pipes. The exhaust system can also include after-treatment devices, such as catalytic converters for reducing pollutants contained in the emissions from the engine and mufflers for reducing exhaust noise. Since temperatures in an exhaust system can reach elevated levels resulting in negative performance or damage to one or more components of the motor vehicle, a heat shield is generally used for reducing the surface temperature of the muffler. Many vehicles have heat shields simply made of stamped metal that surrounds the upper surface of the muffler to protect the underside of the vehicle from the heat generated by the exhaust. In more recent years, additional improvements have been made to better dissipate the exhaust heat and protect neighboring components.

Improvements aimed at managing exhaust heat from vehicles is an ongoing area of development in the art.

SUMMARY

Vehicle exhaust systems generate a significant amount of heat that can be detrimental to neighboring engine components and cause negative impacts to the surrounding area. Heat from exhaust systems can also be a potential safety hazard when the exhaust comes into contact with the external environment.

In one aspect, the disclosure herein provides a muffler heat protection assembly for use with a muffler on a vehicle, the muffler heat protection assembly having a muffler heat shield configured to extend circumferentially around a portion of the muffler, the muffler heat shield having a first end and a second end; and a heat shield extension secured to the first end of the muffler heat shield.

Another aspect of the disclosure provides a heat protection assembly for use with a muffler on a vehicle, the heat protection assembly having a double wall exhaust pipe including an inner exhaust pipe and an outer covering pipe disposed over the inner exhaust pipe, the outer covering pipe having a first end portion and a second end portion, and the inner exhaust pipe having a first end portion and a second end portion, the second end portion of the outer covering pipe configured to be secured to the muffler; and a pipe ring welded to the first end portion of the outer covering pipe and disposed over the inner exhaust pipe, the first end portion of the inner exhaust pipe extending through the pipe ring and being unsecured relative to the pipe ring so as to allow longitudinal movement between the inner exhaust pipe and the outer covering pipe due to thermal expansion. An air space is defined between the inner exhaust pipe and the outer covering pipe.

Further, in another aspect, a muffler system for a vehicle provides a muffler; a muffler heat shield configured to extend circumferentially around a portion of the muffler, the muffler heat shield having a first end and a second end; a heat shield extension secured to the first end of the muffler heat shield; a double wall exhaust pipe including an inner exhaust pipe and an outer covering pipe disposed over the inner exhaust pipe, the outer covering pipe having a first end portion and a second end portion, and the inner exhaust pipe having a first end portion and a second end portion; wherein the second end portion of the outer covering pipe is welded to the muffler at a welded connection seam; and wherein the heat shield extension projects outward over the welded connection seam.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The term "motor vehicle" as used throughout the specification and claims refers to any moving vehicle that is capable of carrying one or more human occupants or cargo in the case of unmanned vehicles, and is powered by any form of energy. The term "motor vehicle" or "vehicle" includes, but is not limited to: All-Terrain Vehicles (ATV), Recreational Off-Highway Vehicles (ROV), cars, trucks, vans, minivans, Sport Utility Vehicles (SUV), motorcycles, scooters, boats, personal watercraft, and aircraft.

Figure 1:
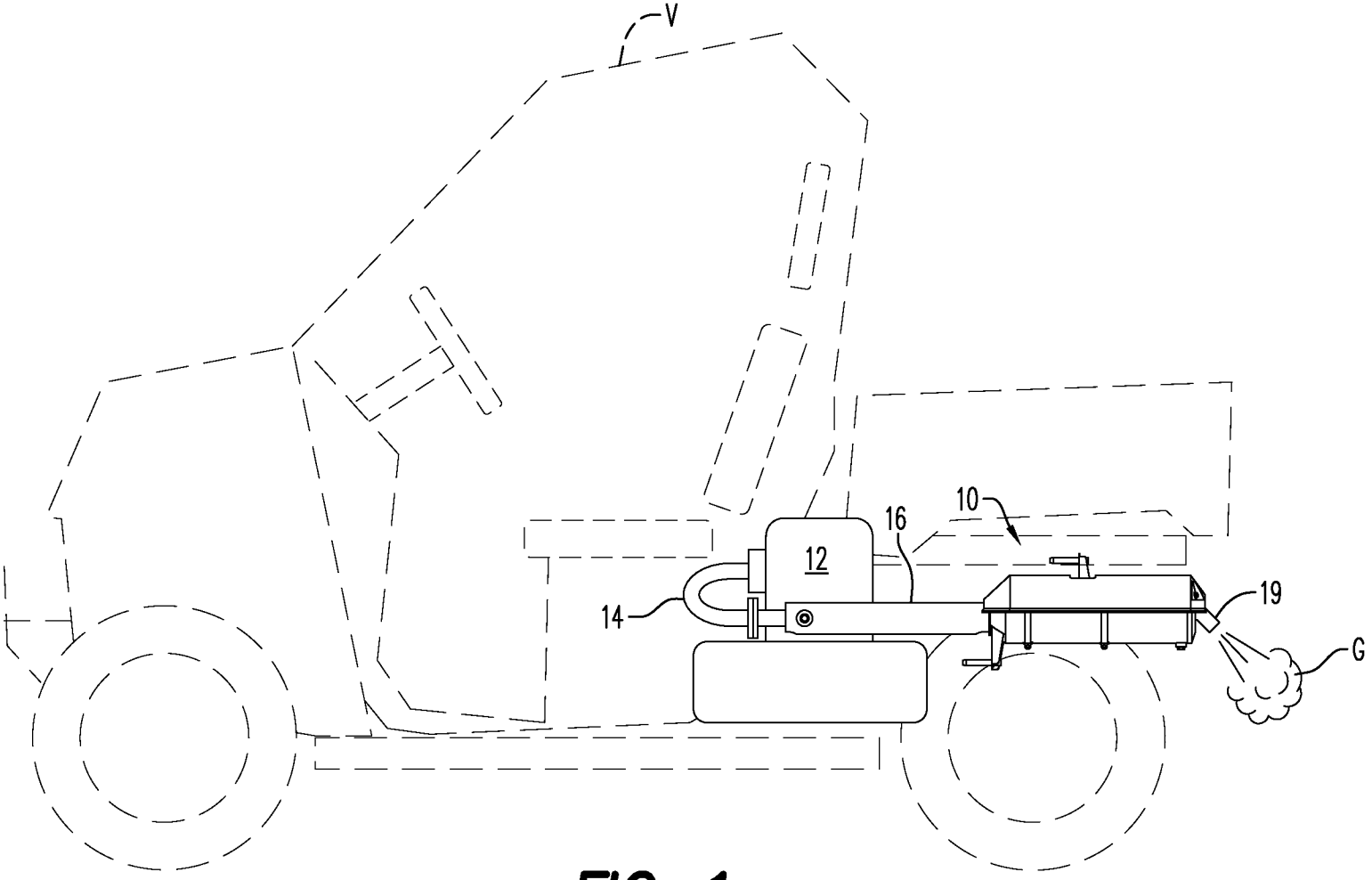
FIG. 1 is a schematic view of an exemplary muffler heat protection assembly for a motor vehicle exhaust system according to the disclosure here.

A muffler heat protection assembly in accordance with an exemplary embodiment of the disclosure is shown generally in FIG. 1 by reference numeral 10. The muffler heat protection assembly 10 is configured for use with a vehicle V to expel exhaust gases from an internal combustion engine 12. The muffler heat protection assembly 10 may be used in connection with an exhaust system having one or more exhaust pipes 14, a muffler 18 as known in the art, and at least one tail pipe 19 which discharges the exhaust gas G into the atmosphere and away from the vehicle. As explained in greater detail below, a double wall exhaust pipe 16 and a muffler heat shield 20 are used to reduce the surface temperature of the muffler 18 and exhaust pipe.

Figure 2:
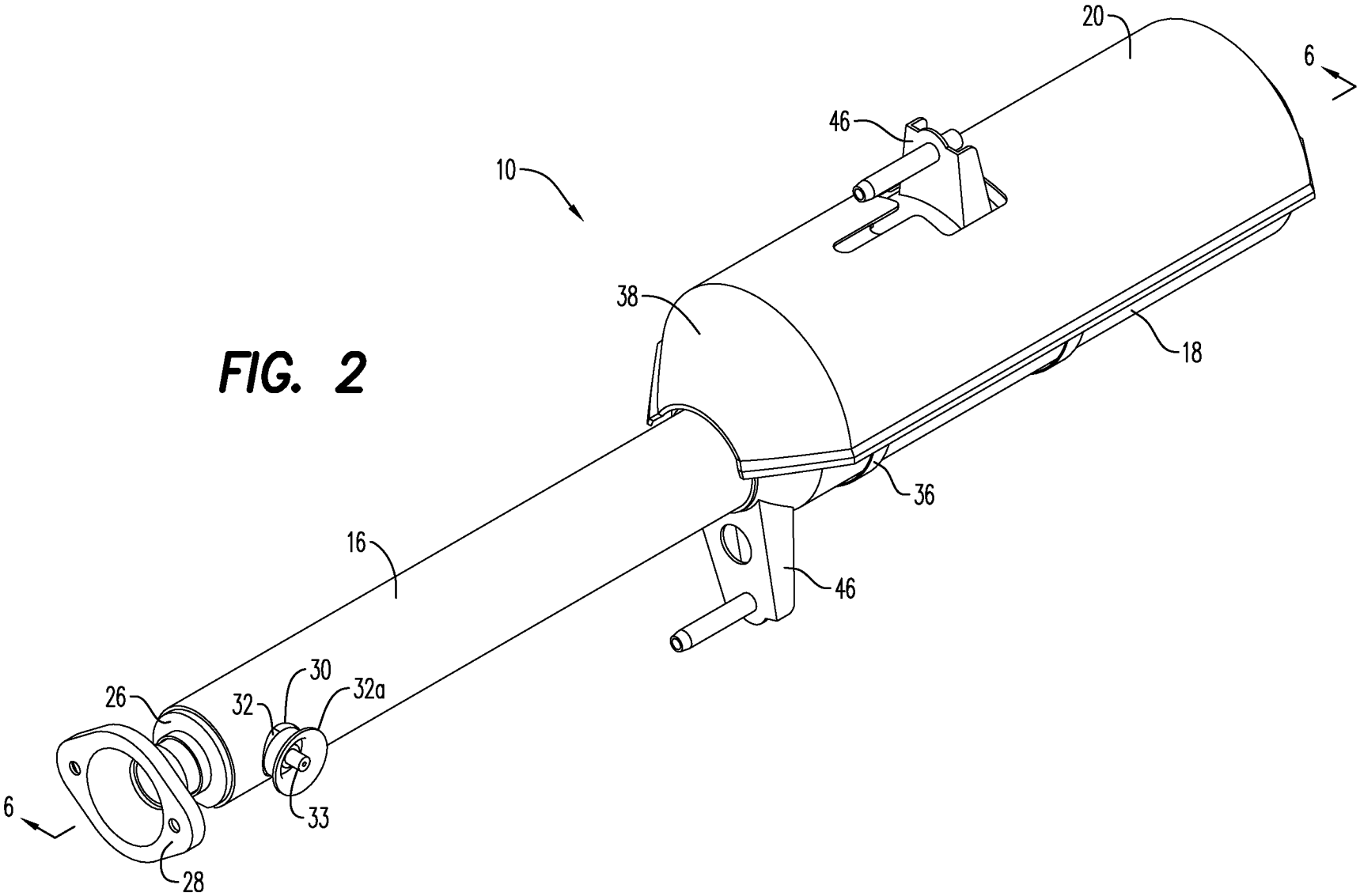
FIG. 2 is a front, top perspective view of a muffler heat protection assembly according to an exemplary embodiment of the disclosure.

Referring also to FIG. 2, the double wall exhaust pipe 16 includes an inner exhaust pipe 22 and an outer insulating pipe 24 disposed around a predetermined longitudinal extent of the inner pipe 22 in order to reduce the skin temperature of the exhaust pipe to a predetermined acceptable heat level. The outer insulating pipe is concentrically disposed over the inner exhaust pipe as shown in the exemplary embodiment. Alternatively, however, the outer insulating pipe could be arranged eccentrically relative to the inner exhaust pipe. The inner pipe 22 includes a flange 28, such as a ball joint flange, to facilitate connection to exhaust pipe 14 or another component in the exhaust system and it extends rearward to the muffler 18. The forward or front side of the outer pipe 24 includes a pipe ring 26 connected thereto by welding or similar attachment means. However, the pipe ring 26 is not welded or otherwise attached to the inner exhaust pipe 22 in order to allow for sliding or other movement of the outer pipe 24 relative to the inner pipe 22 under thermal expansion. The inner pipe 22 and the outer pipe 24 may be formed from different materials and will thus expand and contract at different rates. The outer pipe 24 is thus floating over the inner pipe 22 and will move relative the longitudinal axis due to thermal expansion. The back or rear side of the outer pipe 24 is attached to the front of the muffler 18 by welding or the like.

Figure 3:
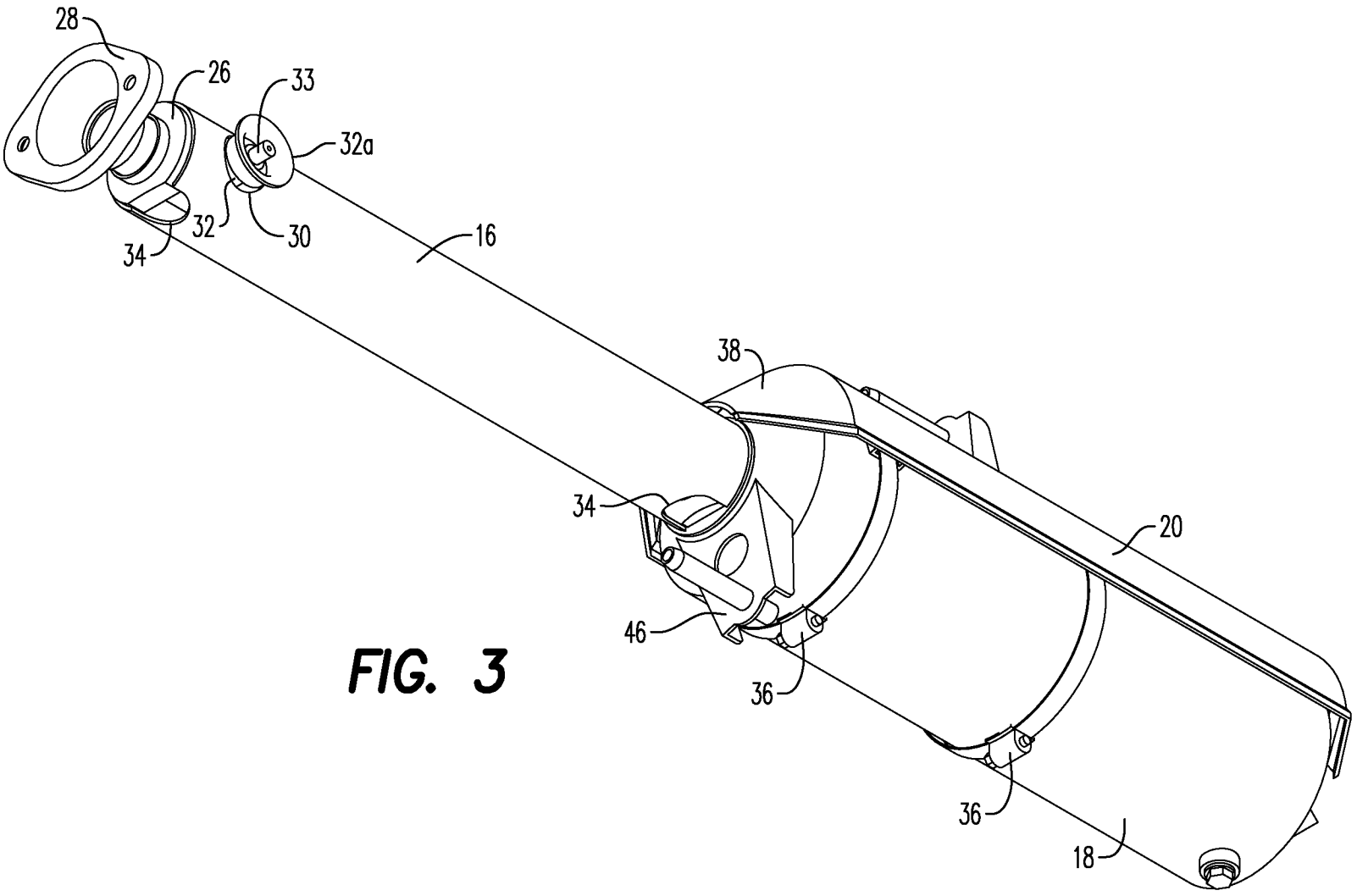
FIG. 3 is a front, bottom perspective view of the muffler heat protection assembly shown in FIG. 2.
Figure 4:
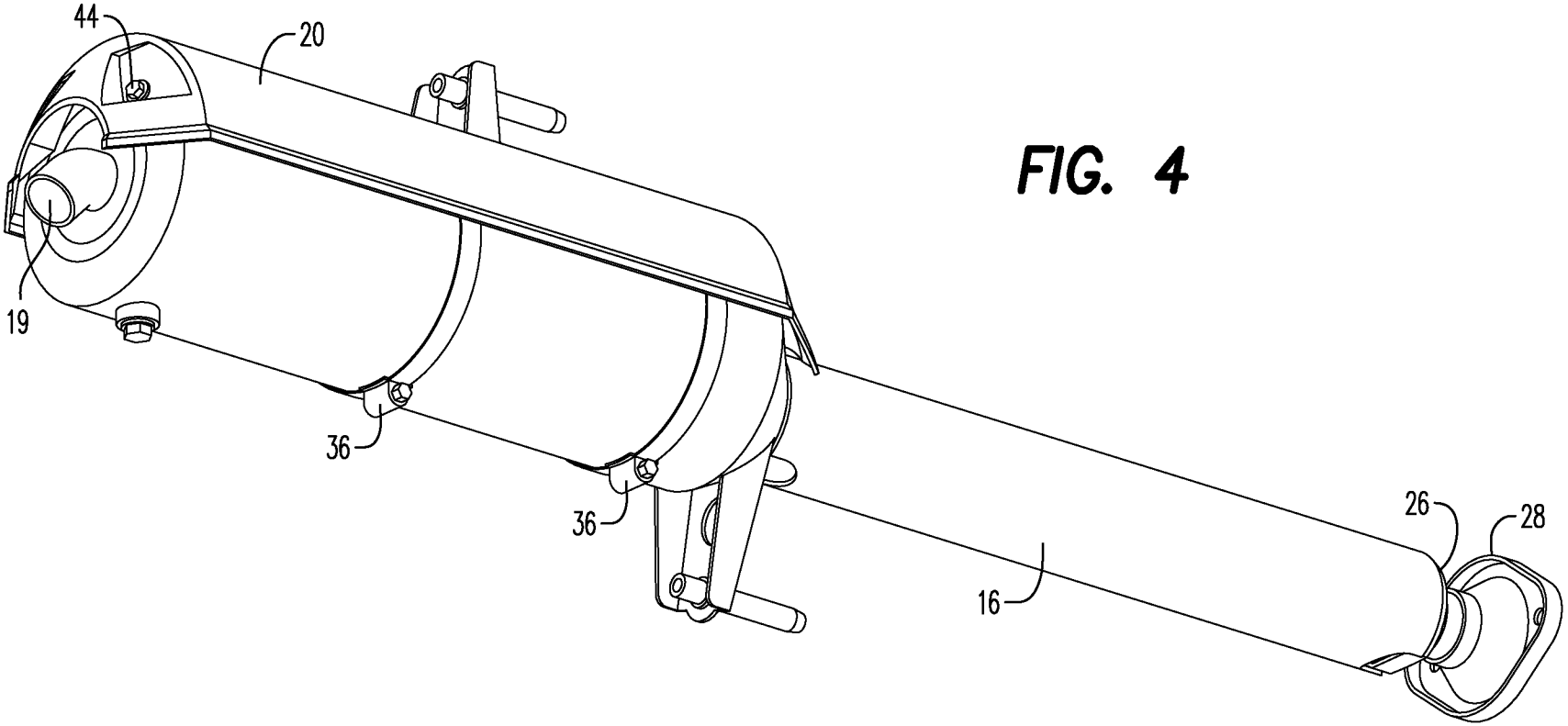
FIG. 4 is a rear bottom perspective view of the muffler heat protection assembly shown in FIG. 2.
Figure 5:
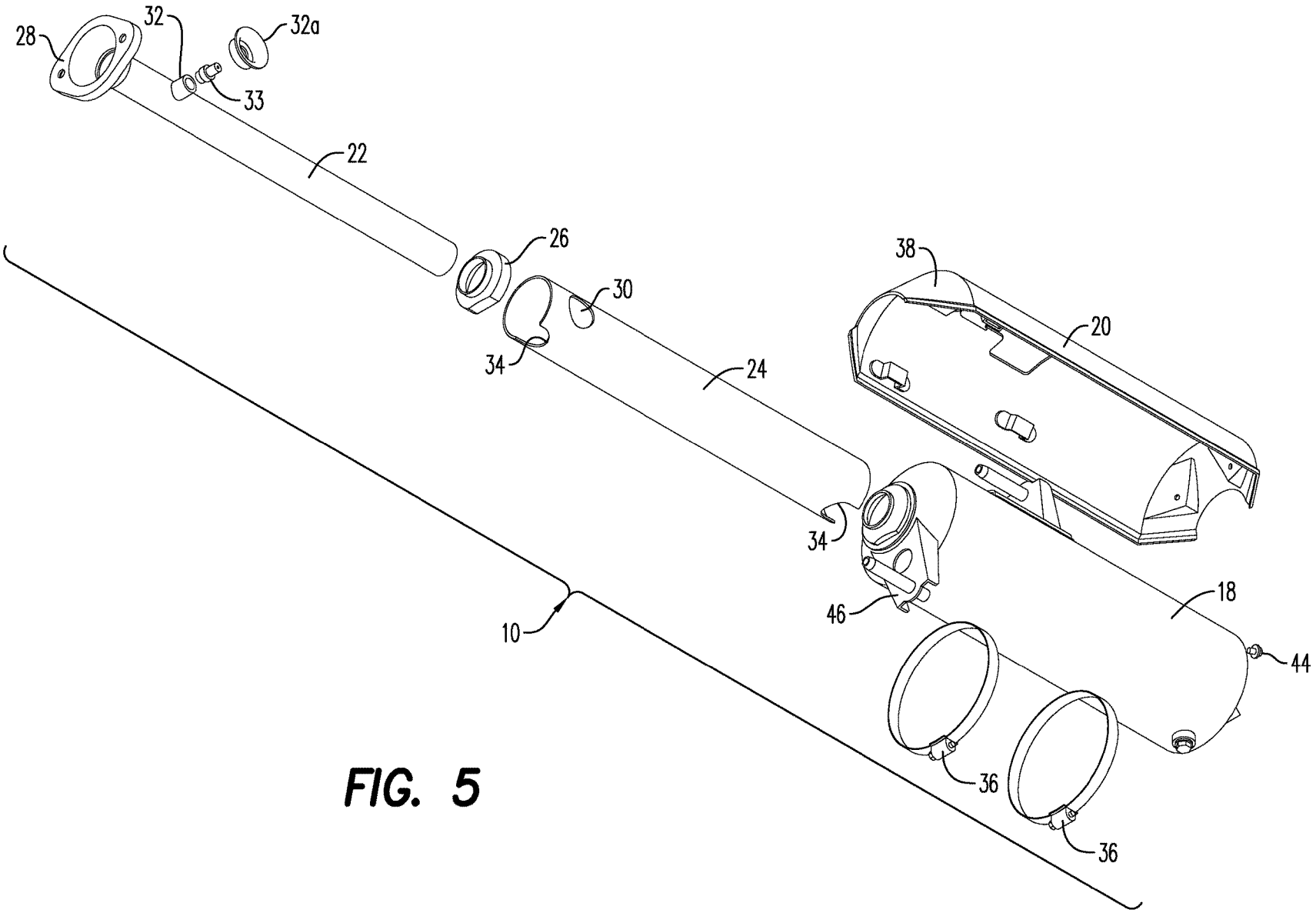
FIG. 5 is an exploded view of the muffler heat protection assembly shown in FIG. 3.

The inner pipe 22 further includes an oxygen sensor assembly configured to measure the oxygen content of the exhaust gas flowing through the inner pipe 22. A boss 32 protrudes from the inner pipe 22 into the space between inner pipe 22 and outer pipe 24 and an oxygen sensor 33 is installed therein. The outer pipe 24 includes an oxygen sensor access cut-out or opening 30 for the oxygen sensor 32. The opening 30 is larger than the oxygen sensor 32 itself in order to allow for thermal expansion. The oxygen sensor assembly may also include a heat shield 32*a* surrounding the boss 32. As shown in FIGS. 3 and 4, the outer pipe 24 further includes drainage openings 34 on opposite ends thereof in order to prevent mud and water from collecting in the double wall pipe 16, i.e., between the inner pipe 22 and the outer pipe 24. That is, any mud, water, or other material entering via opening 30 into the gap between the inner pipe 22 and the outer pipe 24 will be able to easily drain due to gravity through drainage openings 34. As shown in the illustrated embodiment, the drainage openings 34 are formed as semi-circular or crescent shaped cut-outs on the lower or bottom surface of outer pipe 24. The angle of the double wall pipe 16 will change based upon the angle of the vehicle (i.e., parked uphill or downhill), and hence drainage openings 34 are provided on both ends of the outer pipe 24 in order to promote drainage regardless of the incline of the vehicle. Drainage openings can facilitate cleaning of the assembly by applying the nozzle of a pressure washer near the opening.

The muffler heat shield 20 extends axially along the length of the muffler and circumferentially around approximately one-half of the muffler such that at least the width of the muffler 18 is covered by the muffler heat shield 20. As will be apparent to one of skill in the art, coverage may be dictated by surrounding components that need protection from the heat. More particularly, the heat shield 20 has a semi-circular configuration and is disposed over an upper surface of the muffler 18, that is, a surface of the muffler 18 that is facing towards the vehicle V. The heat shield 20 is held in place and spaced from the muffler 18 by a plurality of band clamps 36 extending around the body of the muffler 18. One or more bolts 44 also extend through the rear of the heat shield 20 and secure the heat shield 20 to the body of the muffler 18. The muffler 18 also has one or more muffler stays 46 including a bracket and pin to secure the muffler 18 to the vehicle body, thereby maintaining the muffler 18 and attached heat shield 20 in a fixed location.

Figure 6:
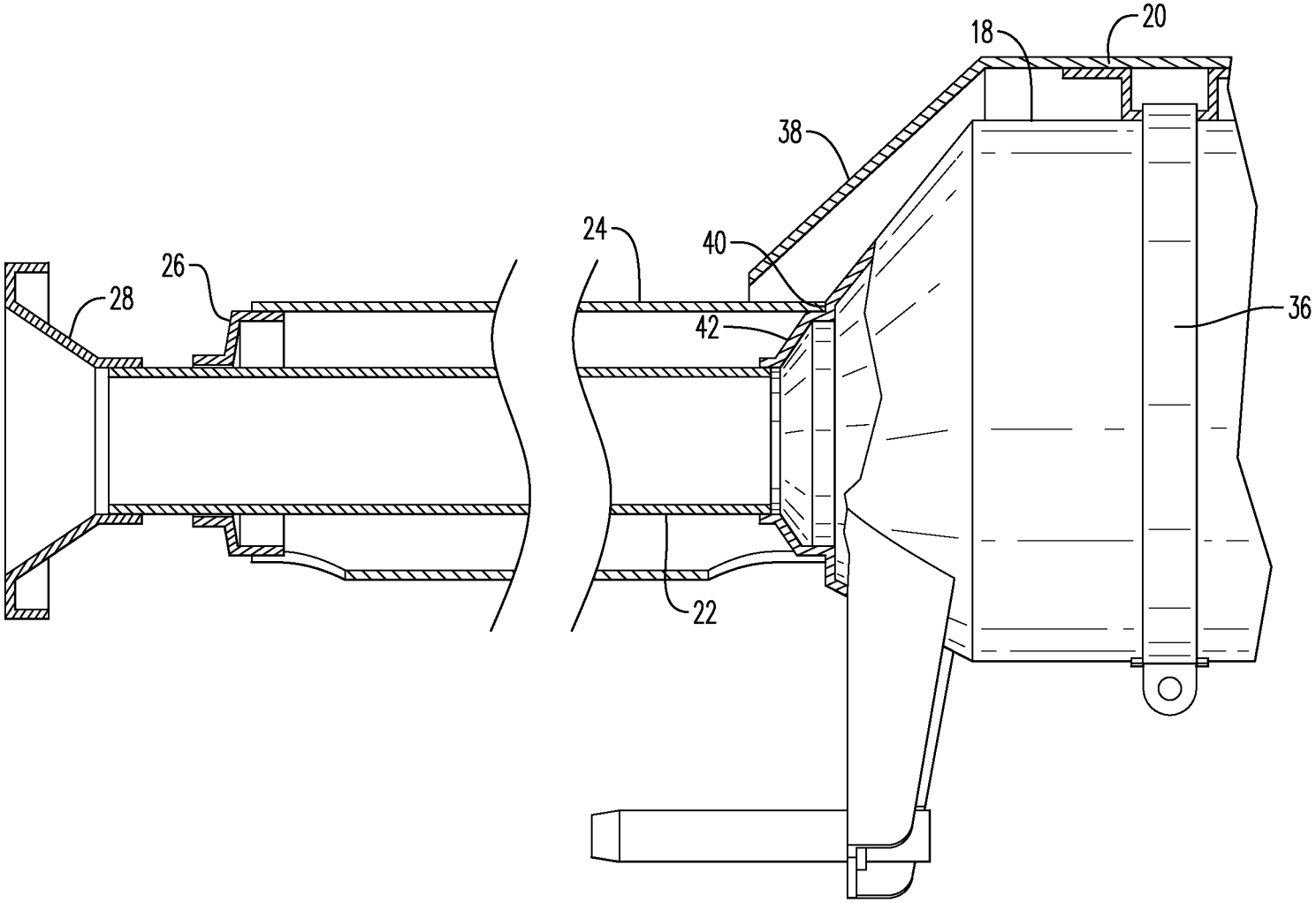
FIG. 6 is a partial cross-sectional view taken generally along line 6-6 shown in FIG. 2.

Referring also to FIG. 6, a forward or front side of the muffler heat shield 20 includes an extension 38 having a generally conical shape which extends beyond the forward end 42 of the muffler 18. The muffler heat shield 20 is sized and positioned relative to the muffler 18 such that the conical shaped extension 38 overlaps the welded connection 40 between the double wall pipe 16 and the forward end 42 of the body of muffler 18. More particularly, the conical shaped extension 38 is configured to overlap an area of extreme high temperature which may be increased due to the presence of a catalyst (not shown) or other component within the forward end 42 of the muffler body.

Accordingly, the muffler heat shield 20 and extension 38 and/or the double wall pipe 16, individually or in combination, provide an improved system for effectively protecting the vehicle from high temperature exhaust gases. Depending on the architecture of the vehicle, the exhaust may be contained within the vehicle instead of an exterior area. Therefore one of the advantages of the present configuration is heat protection on all sides of the exhaust. Moreover, locating the exhaust in the vehicle may prevent it from being damaged with ground contact since a skid plate and frame are expected to contact the ground first on rough terrain.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A muffler heat protection assembly for use with a muffler on a vehicle, the muffler heat protection assembly comprising:

a muffler heat shield configured to extend axially along a length of the muffler and circumferentially around portion of the muffler, said muffler heat shield having a first end and a second end;

a heat shield extension secured to the first end of the muffler heat shield;

wherein the muffler heat shield has a semi-circular shape defining a generally constant radius along the length of the muffler and the heat shield extension has a conical shape and wherein the heat shield extension has a first end and a second end, the first end of the heat shield extension defining a first radius and the second end of the heat shield extension defining a second radius; the second end of the heat shield extension being secured to the first end of the muffler heat shield such that the second radius of the heat shield extension is substantially equal to the generally constant radius of the muffler heat shield; and the second radius of the heat shield extension is greater than the first radius of the heat shield extension such that the heat shield extension has a conical shape.

2. The muffler heat protection assembly according to claim 1, further comprising a double wall exhaust pipe including an inner exhaust pipe and an outer covering pipe disposed over the inner exhaust pipe, the outer covering pipe having a first end portion and a second end portion, and the inner exhaust pipe having a first end portion and a second end portion, the second end portion of the outer covering pipe configured to be secured to the muffler.

3. The muffler heat protection assembly according to claim 2, wherein the heat shield extension projects outwardly from the muffler heat shield so as to overlap the second end portion of the outer covering pipe.

4. The muffler heat protection assembly according to claim 2, wherein the double wall exhaust pipe further comprises a pipe ring secured to the first end portion of the outer covering pipe and disposed over the inner exhaust pipe, the first end portion of the inner exhaust pipe extending through the pipe ring.

5. The muffler heat protection assembly according to claim 2, wherein the inner exhaust pipe includes an oxygen sensor extending through an outer surface thereof, the oxygen sensor configured to sense oxygen content of exhaust gases passing through the inner exhaust pipe.

6. The muffler heat protection assembly according to claim 5, wherein the outer covering pipe includes a through opening aligned with the oxygen sensor and dimensioned larger than the oxygen sensor.

7. The muffler heat protection assembly according to claim 6, wherein the outer covering pipe further includes at least one drainage opening.

8. A heat protection assembly for use with a muffler on a vehicle, the heat protection assembly comprising:

a double wall exhaust pipe including an inner exhaust pipe and an outer covering pipe disposed over the inner exhaust pipe and defining therebetween an air space, the outer covering pipe having a first end portion and a second end portion, and the inner exhaust pipe having a first end portion and a second end portion, the second end portion of the outer covering pipe configured to be secured to the muffler; and a pipe ring welded to the first end portion of the outer covering pipe and disposed over the inner exhaust pipe, the first end portion of the inner exhaust pipe extending through the pipe ring and being unsecured relative to the pipe ring, whereby the inner exhaust pipe is unsecured relative to the outer covering pipe at both the first end portion and the second end portion so as to allow movement between the inner exhaust pipe and the outer covering pipe due to thermal expansion.

9. The heat protection assembly according to claim 8, wherein the inner exhaust pipe includes an oxygen sensor extending through an outer surface of the inner exhaust pipe, the oxygen sensor configured to sense oxygen content of exhaust gases passing through the inner exhaust pipe.

10. The heat protection assembly according to claim 9, wherein the outer covering pipe includes a through opening aligned with the oxygen sensor and dimensioned larger than the oxygen sensor.

11. The muffler heat protection assembly according to claim 10, wherein the outer covering pipe further includes at least one drainage opening.

12. The heat protection assembly according to claim 8, wherein the air space encloses only air between the inner exhaust pipe and the outer covering pipe.

13. A muffler system for a vehicle, the muffler system comprising:

a muffler;

a muffler heat shield configured to extend circumferentially around a portion of the muffler, the muffler heat shield having a first end and a second end;

a heat shield extension secured to the first end of the muffler heat shield;

a double wall exhaust pipe including an inner exhaust pipe and an outer covering pipe disposed over the inner exhaust pipe, the outer covering pipe having a first end portion and a second end portion, and the inner exhaust pipe having a first end portion and a second end portion;

wherein the second end portion of the outer covering pipe is welded to the muffler at a welded connection seam; and wherein the heat shield extension projects outward from the muffler heat shield over the welded connection seam.

14. The muffler system according to claim 13, wherein the outer covering pipe includes a pipe ring welded to the first end portion of the outer covering pipe, the pipe ring being disposed over the inner exhaust pipe, the first end portion of the inner exhaust pipe extending through the pipe ring and being unsecured relative to the pipe ring so as to allow longitudinal movement between the inner exhaust pipe and the outer covering pipe.

15. The muffler system according to claim 13, wherein the muffler heat shield has a semi-circular shape and the heat shield extension has a conical shape.

16. The muffler system according to claim 13, wherein the inner exhaust pipe includes an oxygen sensor extending through an outer surface thereof, the oxygen sensor configured to sense oxygen content of exhaust gases passing through the inner exhaust pipe.

17. The muffler system according to claim 16, wherein the outer covering pipe includes a through opening aligned with the oxygen sensor and dimensioned larger than the oxygen sensor.

18. The muffler system according to claim 17, wherein the outer covering pipe further includes at least one drainage opening.

19. The muffler system according to claim 18, wherein the at least one drainage opening comprises at least one drainage opening in the first end portion of the outer covering pipe and at least one drainage opening in the second end portion of the outer covering pipe.

20. The muffler system according to claim 13, further comprising a plurality of band clamps extending around the muffler and configured to secure the muffler heat shield to the muffler.

* * * * *